United States Patent [19]

Rodot

[11] 4,111,130

[45] Sep. 5, 1978

[54] METHOD OF TRANSFERRING PASSENGERS FROM VEHICLES TO A STATION

[76] Inventor: Frédéric B. Rodot, 6A ave. de l'Ouche, Dijon, France, 21000

[21] Appl. No.: 742,277

[22] Filed: Nov. 16, 1976

[30] Foreign Application Priority Data

Nov. 25, 1975 [FR] France ..... 75 36896

[51] Int. Cl.[2] ..... B61B 1/02

[52] U.S. Cl. ..... 104/28; 104/127; 104/129; 187/52 LC

[58] Field of Search ..... 104/18, 20, 25, 27, 104/28, 29, 30, 127, 128, 129, 89, 122, 124, 138 R; 187/52 LC, 58; 49/120; D25/3

[56] References Cited

U.S. PATENT DOCUMENTS

| | | | |
|---|---|---|---|
| 1,659,608 | 2/1928 | Miller | 104/28 |
| 2,235,381 | 3/1941 | McCormick | 187/52 LC |
| 3,397,649 | 8/1968 | Pfeffer | 104/28 |

FOREIGN PATENT DOCUMENTS

| | | | |
|---|---|---|---|
| 568,213 | 3/1924 | France | 104/25 |
| 2,348,017 | 4/1975 | Fed. Rep. of Germany | 104/28 |

*Primary Examiner*—Randolph A. Reese
*Attorney, Agent, or Firm*—Otto John Munz

[57] ABSTRACT

A station for a transport system comprising a track, an entry level, a transit level vertically spaced from the entry level and at which vehicles or trains may be stopped and two pairs of lifts arranged one pair on each side of the track, the lifts being arranged so that successive lifts arrive at the transit level on opposite sides of the track. A method of synchronizing the passenger lifts and train arrivals and departures is disclosed.

1 Claim, 7 Drawing Figures

METHOD OF TRANSFERRING PASSENGERS FROM VEHICLES TO A STATION

CROSS-REFERENCE TO RELATED APPLICATION

Priority of copending U.S. patent application Ser. No. 719,893, now abandoned is claimed.

BACKGROUND OF THE INVENTION

1. Field of the Invention

The main object of the invention is a station for a line system for transporting people or goods.

2. Description of the Prior Art

In my French Pat. Spec. No. 2,077,133 I have described a transporting system for people or goods, in which a transport vehicle runs on a roller track and is driven by a fluid set in continuous motion at high speed in a channel or canal, into which extends a member which is connected to the vehicle and is subject to the thrust of the fluid. My copending patent application Ser. No. 719,893 filed Sept. 2, 1976 makes provision for the said installation to comprise a plurality of lines, in a closed circuit, forming a system, each line converging towards a central distributing circle, equipped with points for each entry and exit of the lines of the circle. It is then possible to serve stations, arranged at intervals on the different lines, by a series of made-up vehicle trains, which all follow one another on the same single track of the station and are adapted to serve each line in succession, in a given constant order in accordance with a cyclic distribution law. This type of installation is particularly suitable for rail services using short trains at a very high frequency (several per minute), whatever may be the method of propulsion: by means of hydraulic propulsion, by means of a cable, by electric motors or internal combustion engines, or similar methods of traction.

German Offenlegungsschrift No. 23 48 017 describes a conveying line station for passengers in which are used lifts which connect the level of the line and that of the roadway, when these two levels are different.

The station has several lifts, each of which is assigned to one destination; these lifts open on to a platform or passage, on the other side of which the vehicles arrive. This arrangement permits the dimensions of the stations to be reduced and the amount of travel of the passengers to be shortened.

However, such a station does not in any way make best use of the servicing by several lifts which may be expected: actually, on the one hand, it permits the existence of an alignment of lifts and a passage between the lifts and the vehicles, intended particularly for obtaining access to the emergency staircases; on the other hand, the travellers arriving by way of the lifts have to wait until the passengers arriving in the vehicles have left in order to be able in their turn to enter the vehicles: the two streams of passengers are moving in opposite directions, and this causes obstruction and delay.

SUMMARY OF THE INVENTION

According to the invention, I provide a station for a transport system including a track and a plurality of vehicles or trains of vehicles arranged to follow one behind another along the track according to a cyclic program, the station comprising means defining an entry level, means vertically spaced from the entry level defining a transit level at which the vehicles or trains may be stopped in turn for access thereto, and two pairs of lifts arranged one pair on each side of the track, the lifts being arranged to move between and stop at the entry and transit levels in accordance with identical cyclic programs, but with equal phase shifts, and being further arranged so that successive lifts arrive at the transit level on opposite sides of the track.

In one preferred form the entry level lies above the transit level and is connected thereto by a shaft for the lifts.

The cyclic programs of the lifts are preferably so arranged that the lifts, when stopped at the transit level, are disposed in immediate proximity with the train, with their floors at the same level, and their doors facing one another so as in practice to reduce to a single step the passage from a lift to a vehicle.

Furthermore, it is preferred that the cyclic programs of the lifts are such that a lift arrives at the transit level at the same time as a train and it remains at this level until the departure of the following train, which is the moment when the lift moves again towards the other level. Because of this arrangement, when the train N arrives at the station, firstly the lift N-1 is disposed in the waiting position, empty, on one side of the train, having arrived at the transit level at the same time as the train N-1 and ready to receive the ascending passengers, while on the other hand the lift N arrives at the transit level at the same time as the train N, but on the other side of the vehicles to that of the lift N-1, carrying the passengers which intend to use this train N. The lift N-1 leaves the transit level on the departure of the train N and the lift N remains waiting at this level, ready to receive the passengers leaving the train N+1. Moreover, as the doors of the vehicles are not designed for two-way working, but on the contrary, at each station, the departing passengers leave the vehicle by one side door and the entering passengers pass through another side door on another side, there is thus avoided any opposite movement of the passengers, which would be a factor causing confusion and would slow down the movements.

It is important to avoid any danger of accident, which would be due to the opening of either one lift door carrying the passengers without the vehicle being at the station, or a vehicle door at the station without the corresponding lift being ready and waiting. There is thus preferably provided a safety means comprising intermediate doors at the transit level, between vehicles and lifts, these doors only being opened if a vehicle and a lift are simultaneously disposed on either side of them. Furthermore, the opening or closing of these doors is preferably arranged to cause mechanically the same movement of the doors of the vehicles.

An emergency exit for passengers can be provided so that passengers can reach the entry level, in the event of the lifts failing, by way of a zig-zag staircase, preferably mounted along the inside wall of the shaft in the case of an underground transit level, and terminating at the entry level close to one of the exits from the station.

At the entry level the station is provided in a diametrically opposed arrangement with two entries and two exits. Each entry can thus be made to serve one or more lifts, into which the passengers for the trains have access through external side doors, while the passengers from the trains leave the lifts through internal side doors so as to be directed towards the exits. This arrangement avoids any opposite movement of the passengers at the entry level and it is a factor as regards the fluid and rapid circulation of the said passengers.

A preferred station for an underground transport system has its entry level formed as a cylinder above which is arranged a cupola, above the shaft. This has the effect of reducing the free air space of the station.

In contrast to the conventional stations for access to underground transport lines in general, and also to the stations described in German Offenlegungsschrift No. 23 48 017, the described station offers the following advantages:

it reduces the cost of construction by limiting the excavation to a single vertical cylindrical shaft of small diameter for each station, for example, of the order of 7 meters, for made-up trains of two coupled vehicles each with ten seats; this corresponding to 6000 seats per hour for a frequency of five departures per minute;

it reduces the fatigue of the travellers by making them have direct access to a lift or to a vehicle, and vice versa, without any intermediate travelling;

consequently, it reduces the lost time involved during transport by eliminating the movement along passages, staircases, platforms, and making simultaneous the entry to and exit from the vehicle through opposite side doors.

It will be appreciated by those skilled in the art that, although the invention has been particularly described in relation to passenger traffic, it is also applicable in the movement of goods.

The invention has been particularly described in relation to an underground track system. However, it is also applicable to overhead forms of above-ground transport, e.g., elevated railways, whether of conventional dual-rail or mono-rail type. In this case it is not necessary to provide a closed-in shaft for the lifts but it is sufficient merely to provide an open framework.

In order that the invention may be clearly understood and readily carried into effect a preferred embodiment thereof will now be described, by way for example only, with reference to the accompanying drawings.

DESCRIPTION OF THE PREFERRED EMBODIMENT

Figure 1:
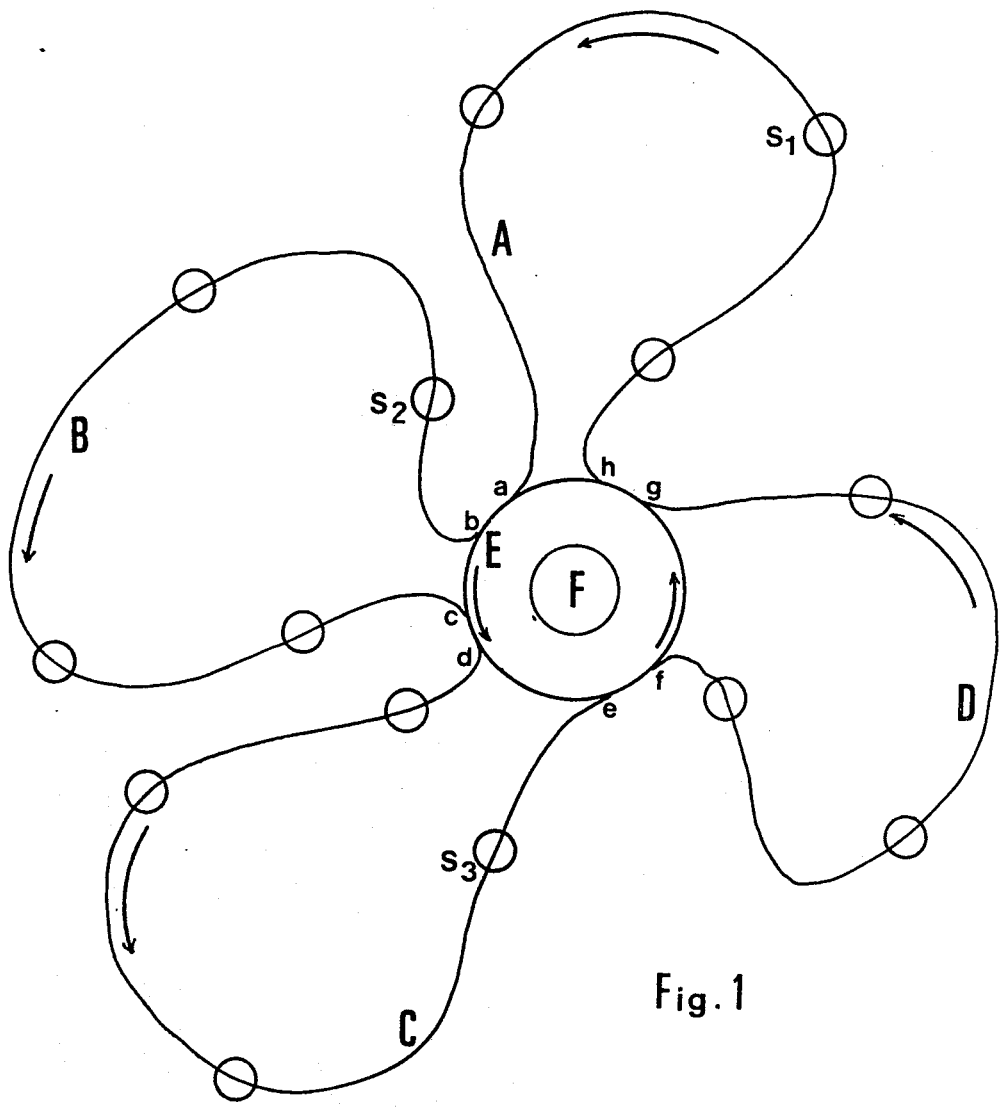
FIG. 1 represents diagrammatically a system of lines served by a number of stations according to the invention.

Referring to the drawings, FIG. 1 shows a transport line system, such as described in my copending patent application Ser. No. 719,893, which is served by a number of stations $S_1$, $S_2$, $S_3$, $S_4$, etc., in accordance with the invention. The system of FIG. 1 has, for example, four lines A, B, C, D, all converging on a central distribution circle E, and permits a town of average size to be served. A central Control station F is shown, this advantageously being placed inside the circle. Made-up trains of vehicles follow one another at a regular interval in each destination station of the lines A, B, . . . etc., in accordance with a cyclic law of distribution of these destinations. At each station, a signal indicates the destination line of the first train to arrive. Thus, at the station $S_1$, for example, the first train will first of all travel along a section of the line A, as indicated by the arrow, then through an almost complete turn of the circle E in order to arrive at the second section of the line A. The second train will travel along the same first section of the line A and then along the line B; the third train will travel along the line C and the fourth train along the line D. In this way, by selecting his train of vehicles, the travaller will reach the station of his choice from station $S_1$ without changing vehicles. For a passenger departing from station $S_2$ there will also be a choice of four trains arriving in succession, the first train, for example, travelling along a section of line B, then around most of circle E and back to line B. The second will travel along the same length of line B and then along line C; the third will travel also along line B and then line D and the fourth will be a train that has come from line A. Similar series of trains pass through stations $S_3$ and $S_4$ enabling a passenger starting from either of these stations to reach any other without changing trains. In all 10 "routes" are provided.

Figure 2:
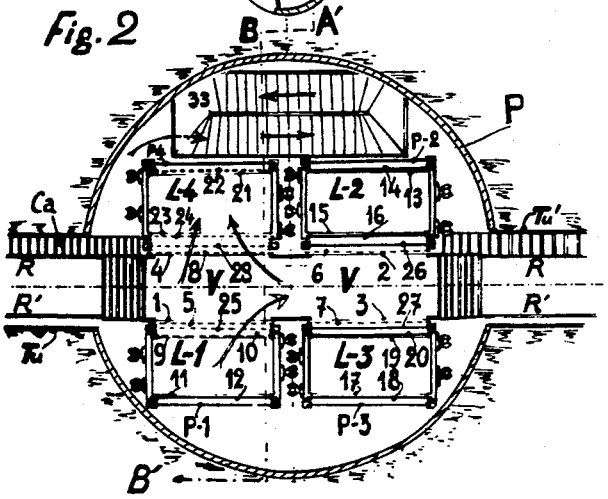
FIG. 2 represents the transit level of one of the stations of the system of FIG. 1.

FIG. 2 shows the transit level, i.e., the lower level of a station such as $S_1$ in FIG. 1, set up on a fourline system. The shaft can be seen at P and the traffic arrival tunnel for the vehicles on the rails R and R' can be seen at T*u*, T*u*'. A train formed of two identical coupled vehicles V is in the station. It has four openings 1, 2, 3 and 4 for the passage of the travellers, which openings can be closed by four doors, for example, sliding doors 5, 6, 7 and 8. Each opening in the vehicle faces an opening of the same dimensions of a lift belonging to a group of four lifts L1, L2, L3 et L4. In FIG. 2, the four lifts have been shown in position at the transit level to facilitate the reader's understanding of the correspondence of their openings and doors with those of the vehicles. In actual fact, as will be seen from the working diagrams (FIGS. 4 and 5), there are only two lifts present at the same time at the transit level when a train is stopped in the station.

Each lift has an opening and a door on the side facing the adjacent vehicle V and an opening and a door on the opposite side. Thus, lift L1 has two opposite openings 9 and 11, to which correspond the two doors 10 and 12. Similarly, lift L2 has two openings 13 and 15 and two doors 14 and 16; lift L3 has two openings 17 and 19 and two doors 18 and 20 and lift L4 has two openings 21 and 23 and two doors 22 and 24.

Four safety doors are provided between those of the lifts and the vehicles, so as to prevent the travellers from attempting to pass in the event that the doors of the lifts and those of the vehicles are not exactly facing one another and in the event that a lift and the corresponding vehicle are not in correct sequence and one of them is absent at the transit level. These safety doors are indicated at 25, 26, 27 and 28.

The groups of three doors (vehicle, safety, lift), whose simultaneous opening establishes a passage for the travellers, are dependent for their opening and closing movements on a safety device which is not described and which is of known type. This safety device can be either electrical, mechanical, hydraulic or pneumatic in operation. This device only functions upon the respective openings 1 and 9, 2 and 15, 3 and 19 and 4 and 23 stopping facing one another.

Four landing doors P1, P2, P3 and P4 close the respective lift cages at the transit level on the side opposite the train.

Figure 3:
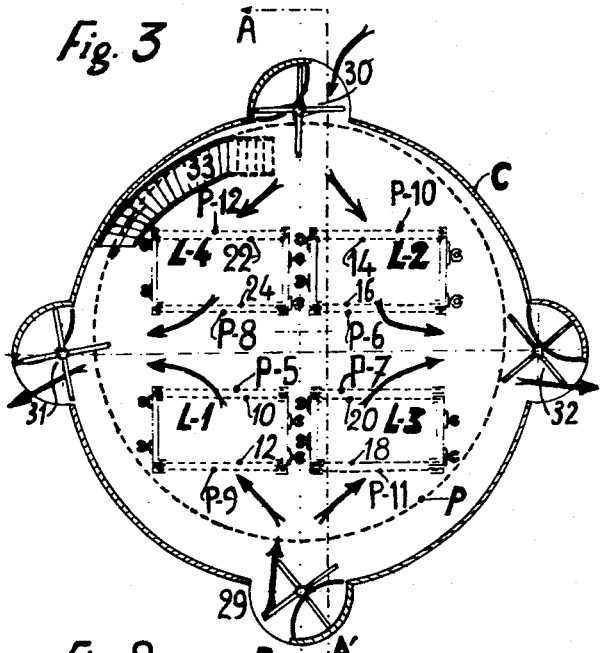
FIG. 3 represents the upper level of the station of FIG. 2.

In FIG. 3, which represents the upper level of the station, the four lifts L1 to L4 have also been indicated at the upper level, for greater convenience in explanation, although all four lifts never stop simultaneously at this level. In addition, there is visible the outline of cupola C which forms the roof of the station, and an emergency staircase 33, whose starting point is at the transit level (FIG. 2). Eight landing doors P5 to P 12 permit the lift cages to be closed when the latter are not present. Four turnstiles, consisting of two entry turnstiles 29 and 30, for example, of the pre-payment type, and two exit turnstiles 31 and 32, permit the access and the exit of the travellers. As will be subsequently seen from the working diagram of the lifts in FIG. 5, the lifts are not intended for multiple working, but each of them only serves a single line. This particular feature, by appropriate positioning of barriers (not shown) at the transit level, permits the entry 29 to be made specific for the lines 1 and 3, and the entry 30 for the lines 2 and 4, and likewise of enabling the passengers of two lines to make their exit through the exit 31 and of the other two lines through the exit 32.

Figure 4:
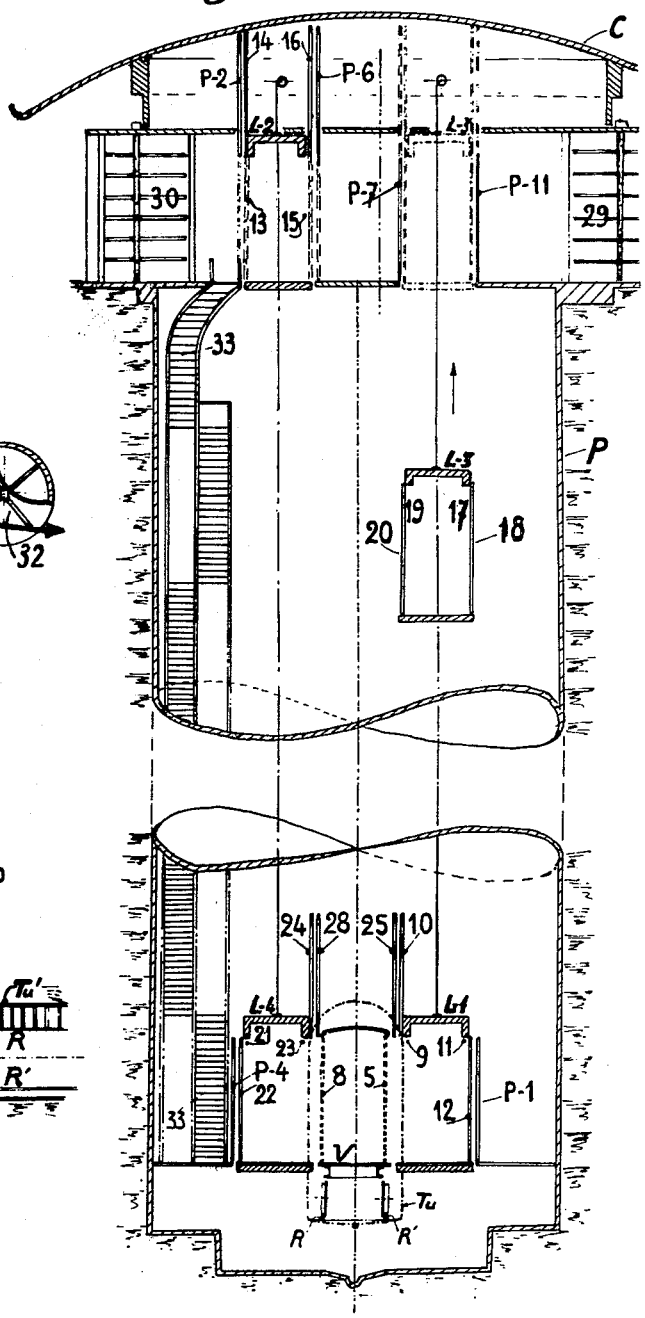
FIG. 4 represents a vertical section of the station of FIGS. 2 and 3.

FIG. 4 is a sectionnal view showing the station in course of operation at a moment when L1 and L4 are at the transit level, L2 is at the upper level and L3 is ascending. This situation corresponds to the dotted line 50" on the working diagram of the lifts as shown in FIG. 5.

Figure 5:
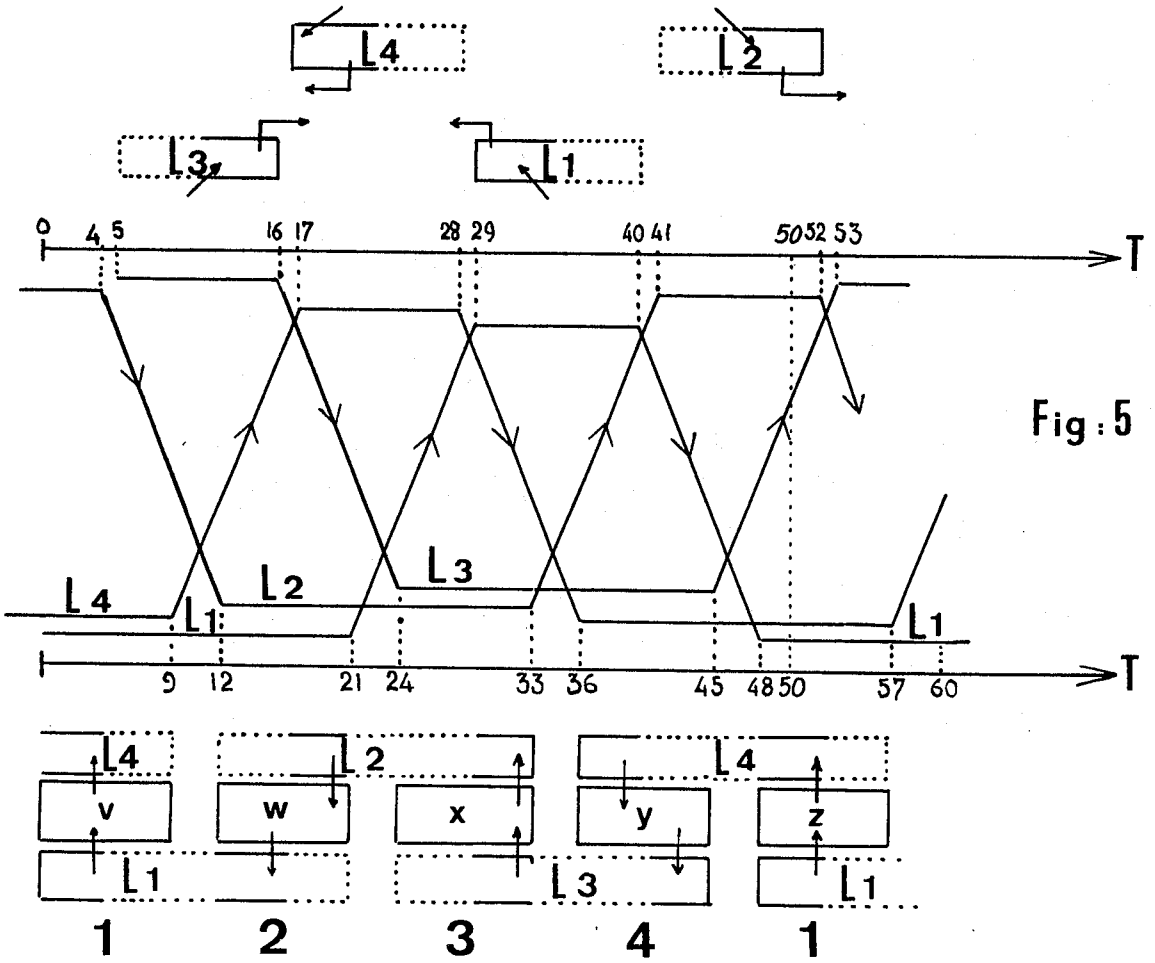
FIG. 5 is a working diagram of four lifts serving the station of FIGS. 2 to 4, and FIGS. 6 and 7 are perspective views of a mechanical arrangement for opening the doors of the vehicles by the intermediate doors.

The operational cycle of the station is now described by referring to FIG. 5, in which a station has four lifts L1, L2, L3 and L4, as in the previous figures, and in which the vehicles in succession serve four lines.

In this figure, for convenience in understanding the movements, the time axis T has been shown twice, top and bottom; it is graduated in seconds. The top of the figure corresponds to the upper level, the middle part of the figure between the two identical axes T represents the movements of the lifts L1, L2, L3 and L4 and the bottom of the figure represents the transit level with the sequence of the vehicles, the lifts serving them and the lines.

Reference letters *v*, *w*, *x*, *y* and *z* represent vehicle trains which follow one another at the station; 1, 2, 3 and 4 are the numbers of the lines. Hence, following one another at the station are: train *v* with a destination on the line 1, train *w* with a destination on the line 2, train *x* with a destination on the line 3, train *y* with a destination on the line 4 and train *z* with a destination on the line 1. After train *z*, other trains follow one another which in succession have a destination on the lines 2, 3 and 4, respectively, and so on.

It is of course understood that the times which are to be indicated below are only given as examples and that a cyclic law different from that which is to be set out would permit working of the station.

Let it be assumed that a number of made-up trains of two vehicles, such as those in FIGS. 2 and 3, follow one another every 12 seconds and that the time for the ascent or descent of the lifts is 8 seconds.

At $T = 0$ seconds, train *v* serving the line 1, is stopped and lift L1, which was descending, is also stopped. Lift 4 is waiting, stopped, open and empty.

At $T = 1$ second, the six doors 5 and 25, 10 and 8, 28 and 24 are opened and remain open until $T = 8$ seconds.

During this time interval, the passengers leaving train *v* pass into lift L4 and the passengers entering train *v* leave lift L1. These movements do not cause any hold up, because they do not cross one another. At $T = 8$ seconds the doors are closed. At $T = 9$ seconds, train *v* leaves and lift L4 brings the passengers who have left train *v* towards the upper level. Lift L1 remains waiting at the transit level, stopped, open and empty. At this moment ($T = 9$ seconds), lift L2 is descending with the passengers for a destination on the line 2, and lift L3 at the upper level receives the passengers for a destination on the line 3.

At $T = 12$ seconds, train *w*, serving the line 2, is stopped and lift L2 arrives at the transit level. From $T = 12$ seconds until $T = 21$ seconds, lifts L1 and L2, at the transit level, have the same function in relation to train *w*, as lifts L4 and L1 had in relation to train *v* in the preceding period of $T = 0$ seconds to $T = 9$ seconds. The operations of opening and closing the doors follow one another in the same manner at $T = 13$ seconds and $T = 20$ seconds, allowing the passengers entering train *w* and leaving it the same time for their transit between lift L2 and train *w*, on the one hand, and train *w* and lift L1 on the other hand. At $T = 21$ seconds, train *w* leaves and lift L1 ascends again.

At $T = 24$ seconds, train *x*, serving the line 3, stops and lift L3 arrives at the transit level; similar operations to those previously then take place involving lifts L3 and L2.

At $T = 36$ seconds, train *y*, serving the line 4, stops and lift L4 arrives at the transit level; the same operations then also take place.

At $T = 48$ seconds, train *z*, serving the line 1, arrives at station $S_1$ at the same time as lift L1 arrives at the transit level, while lift 4 is waiting empty, open and stopped.

As regards the situation indicated in FIG. 4, in which lifts L1 and L4 are at the transit level, lift L2 is at the upper level and lift L3 is ascending, it corresponds to the times $T = 2$ seconds and $T = 50$ seconds and so on. Generally speaking, $T = (2 + n \times 48)$ seconds.

It is seen that the cycle is completed at $T = 48$ seconds, since at this moment there is once again obtained the same situation as at $T = 0$ seconds. The characteristic of a station in accordance with the invention thus becomes apparent, namely, that when the vehicle trains stop at regular intervals and have destinations which follow one another in accordance with a cyclic law of distribution, the lifts are displaced from one level to the other in accordance with identical cyclic programs, with equal shifts in phase, and having the same period as the said cyclic distribution law. In the example indicated in FIG. 5, this common period is 48 second: a lift, for example lift L1, arrives at the transit level every 48 seconds and the vehicles serving any one line also follow one another with a periodicity of 48 seconds, as is seen with trains *v* and *z*.

In the example as given, it is noted that the time during which the lift is stationary at the upper level is 11 seconds. This time is quite sufficient to permit the simultaneous exit of the passengers who have ascended and the entry of the passengers who are to descend, but here once again these movements are not crossed or in opposite directions, but are effected through opposite side doors.

Finally, in the tunnel, upstream of the station $S_1$ under consideration, illuminated panels will be provided which indicate: "NEXT STATION - $S_1$ - ." Furthermore, with the object of assembling in the vehicles the passengers who are to descend at $S_1$ in front of the door which is to open, the following device will also become operative: L4, during its stay at the transit level, will trigger the illumination, in the same tunnel, of flashing panels which indicate: "EXIT BY DOOR 4" or "EXIT BY RED DOOR." The passengers in the vehicle *v* will then know where they have to get out. Likewise, the lift L1 will announce to the passengers of train *w* that they have to go to the door 1 (or green door), lift L2 will announce to the passengers of train *x* that they have to go to the door 2 (or yellow door), while lift L3 will announce to the passengers of train *y* that they have to go to the door 3 (or blue door), and so forth.

Figure 6:
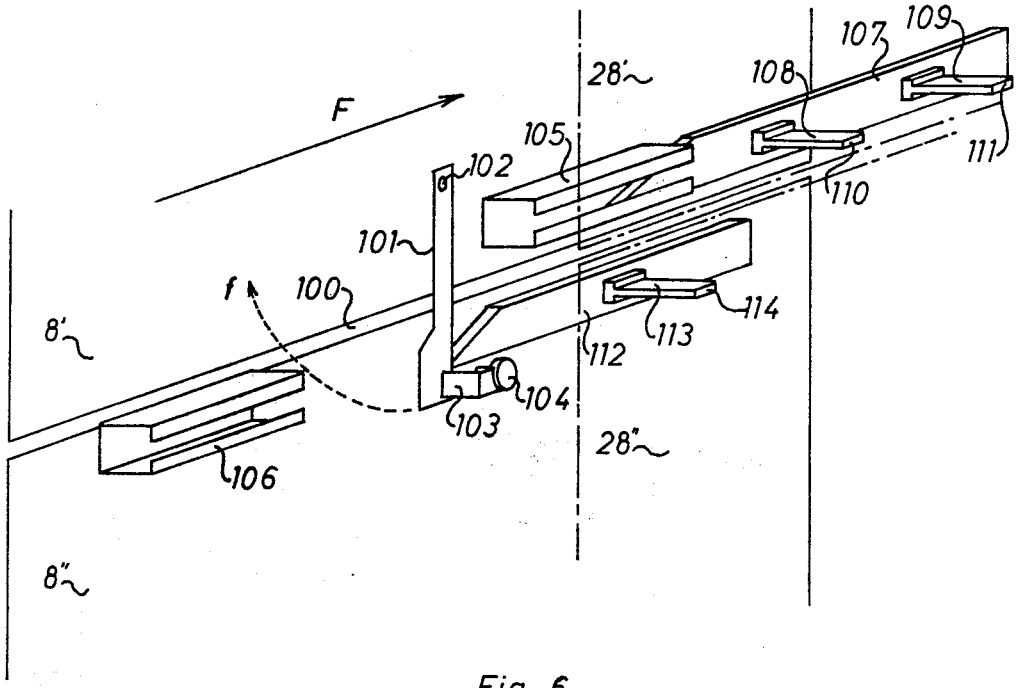

FIG. 6 shows a partially diagrammatic and perspective view of the door 8 of the vehicle *v* from outside the vehicle. It is in two parts, an upper part 8′ and a lower part 8″. For convenience in illustration, a space 100 has been shown between the two parts 8′ and 8″, which normally would be in contact.

The upper part 8′ carries a latch 101 which is movable about a pivot 102 and has hook 103 which can engage a peg or hook 104 of the lower part 8″, so as to hold the two parts of the door 8 fast with one another. Mounted on the part 8′ is a horizontal slideway 105, while another horizontal slideway 106 is provided on the part 8″. This latter slideway is positioned in such a way as to permit a free rotation of the latch 101 about the pivot 102.

The intermediate safety door 28, which separates the door 8 from the door 24 of the lift L4 (see FIG. 2) has also been partially represenented in broken lines in FIG. 6. The door 28 is itself also in two parts, an upper part 28′ and a lower part 28″. The upper part 28′ carries a thin plate 107, of which one end is bevelled and is held by two lugs 108 and 109 at two points 110 and 111. The lower part 28″ carries a thin plate 112, of which one end is bevelled and is held by a lug 113 at a point 114.

FIG. 6 shows the situation when the vehicle *v* is being moved in the direction of the arrow F and at the moment when it arrives at the station just before it stops. The slideway 105 starts to receive the plate 107, and the latch 101 is in contact with the bevelled end of the plate 112. As the vehicle continues to move in the direction of the arrow F, the plate 112 acting on the latch 101 causes it to initiate a rotational movement as indicated at *f* about the pivot 102, and thus starts to disengage the peg or stud 104 from the hook 103.

During the completion of the movement of the vehicle, the plate 107, engaged in the slideway 105, in its turn acts on the latch 101, which continues its rotational movement about the pivot 102.

Figure 7:
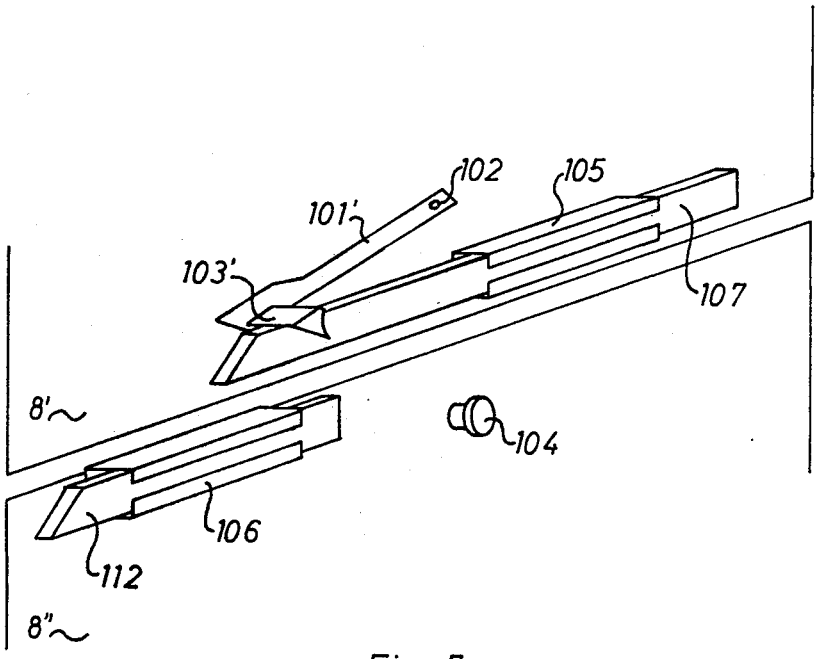

FIG. 7 shows the position when the vehicle is stopped. In order to simplify the illustration, the door 28 and the lugs 108, 109, and 113 have not been shown. The thin plates 107 and 112 have been respectively engaged in the slideways 105 and 106. The latch 101 and its hook 103 occupy the positions 101′ and 103′, the stud 104 being completely disengaged from the hook 103. In this situation, the device for opening the door 28, which is not shown and is of known type, becomes operative in such a way as to disengage the part 28′ in the upward direction and the part 28″ in the downward direction. The parts 8′ and 8″ of the door 8 of the vehicle, respectively made fast with the parts 28′ and 28″ of the intermediate safety door 28, then also make available the passage for the transit of the passengers.

The closing of the door 28 causes the closing of the door 8, and the starting of the vehicle, always in the direction of the arrow F, ensures the disengagement of the plates 107 and 112 from the slideways 105 and 106 respectively, and also the descent of the latch 101 and the locking of the stud 104 by the hook 103.

In the claims the term "vehicle" is to be interpreted as inclusive of a plurality of vehicles coupled in succession for translation as a unit on and along the track.

I claim:

1. The method of operating in synchronism, vehicles moving in succession at predetermined time intervals on and along a roadway at a transit level, with four lifts L1, L2, L3 and L4 translatable vertically between the transit level and an entry level spaced vertically from the transit level, there being two lifts in side-by-side relation on each respective side of the track, lifts L1 and L4 being directly opposite and lifts L2 and L3 being directly opposite, said method comprising: emplacing lifts L4 and L1 at the transit level on arrival of a first vehicle at the transit level, for entrance to and exit from the first vehicle, respectively, translating lift L4 to the entry level on departure of the first vehicle, while leaving lift L1 at the transit level pending arrival of the second vehicle, emplacing lift L2 at the transit level on arrival of the second vehicle at the transit level for entrance to and exit from lifts L1 and L2 respectively, translating lift L1 to the entry level on departure of the second vehicle while leaving lift L2 at the transit level pending arrival of the third succeeding vehicle, emplacing lift L3 at the transit level on arrival of the third vehicle for entrance to and exit from lifts L2 and L3, respectively, translating lift L2 to the entry level on departure of the third vehicle, while leaving lift L3 at the transit level pending arrival of the fourth succeeding vehicle, emplacing lift L4 at the transit level on arrival of the fourth succeeding vehicle for entrance to and exit from lifts L3 and L4, respectively, leaving lift L4 at the transit level pending arrival of the fifth succeeding vehicle, and repeating the timed arrival and departure of vehicles and translation of lifts, as aforesaid.

* * * * *